United States Patent [19]

Caldwell

[11] 4,275,433

[45] Jun. 23, 1981

[54] LIGHTING FITTING

[75] Inventor: James Caldwell, Altrincham, England

[73] Assignee: Dashglow Limited, London, England

[21] Appl. No.: 36,216

[22] Filed: May 4, 1979

[51] Int. Cl.[3] ..... F21V 25/00

[52] U.S. Cl. ..... 362/22; 362/267; 362/276; 362/294; 362/375; 362/390

[58] Field of Search ..... 362/21, 22, 276, 390, 362/294, 267, 375

[56] References Cited

U.S. PATENT DOCUMENTS 583,959 6/1897 Waegel ..... 362/22

*Primary Examiner*—Stephen J. Lechert, Jr.
*Attorney, Agent, or Firm*—Alan H. Levine

[57] ABSTRACT

An electrical lighting fitting for a remotely hazardous area comprises two enclosures. The lamp itself is disposed in one enclosure and the control equipment for the lamp is disposed in the other around the axis of the fitting. The two enclosures are thermally insulated from each other and at least the one containing the lamp is maintained at a pressure other than ambient. A pressure switch is associated with this enclosure so that should a break occur in the enclosure this can be sensed and the electrical supply to the lamp removed. The thermal insulation enables the lamp to be run in temperatures which would not otherwise be possible. The enclosure housing of the lamp may be fixed to the remainder of the lamp by springs to enable lamp maintenance without the use of tools.

16 Claims, 9 Drawing Figures

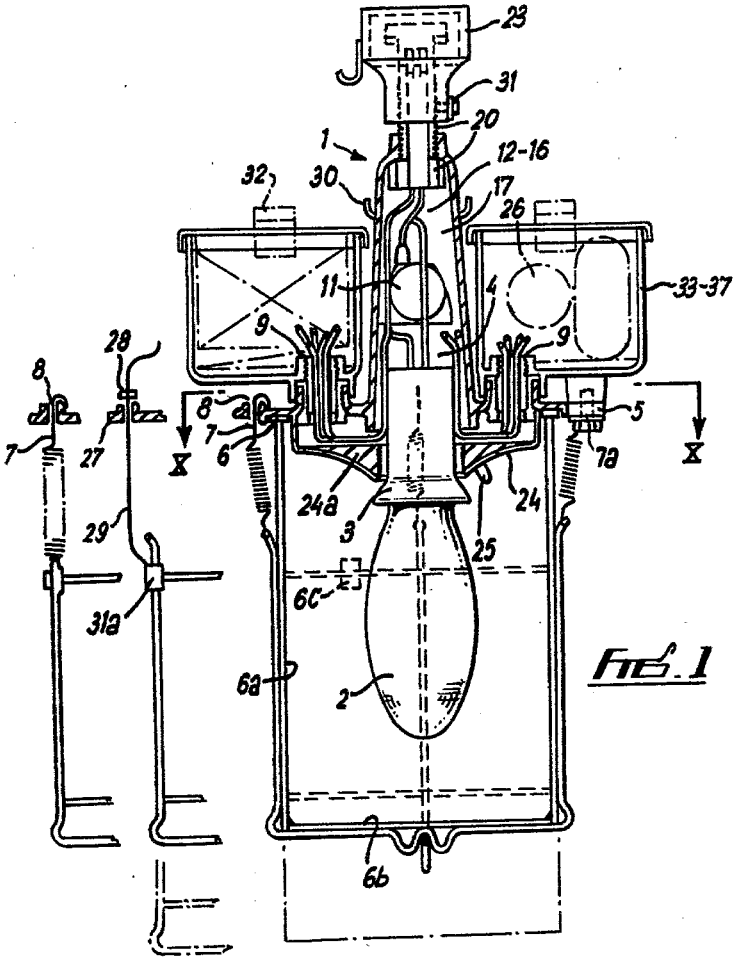
FIG. 1
FIG. 1A
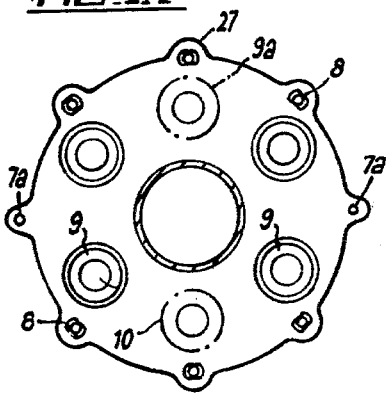
FIG. 3
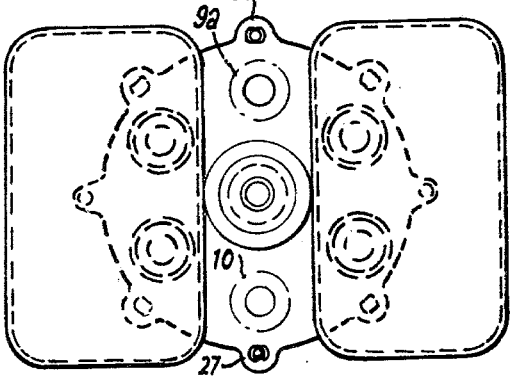

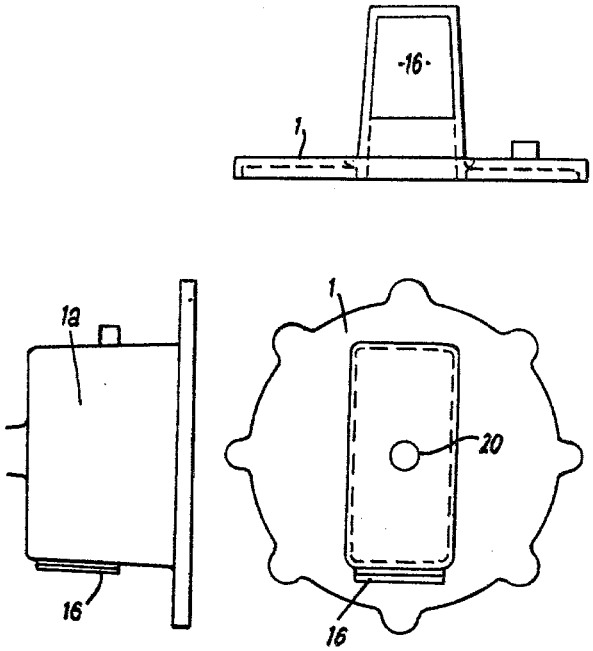
FIG. 2
FIG. 8
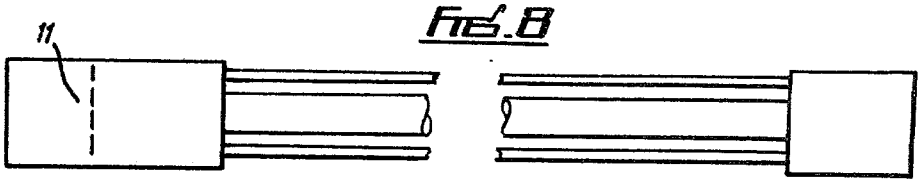
FIG. 9
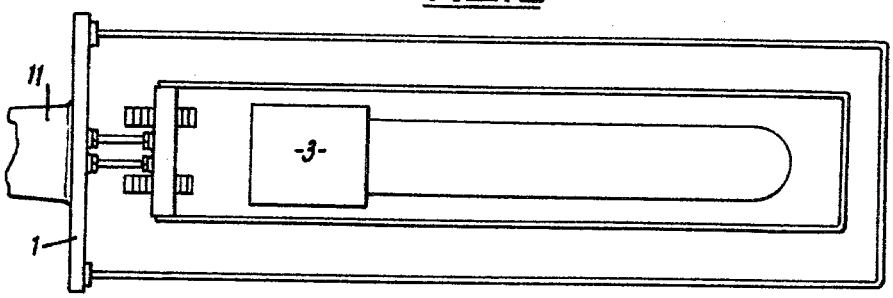

LIGHTING FITTING

The invention relates to a lighting fitting particularly, but not exclusively, fittings for use in an explosive, hazardous, remotely-hazardous, hygenic, dust or anti-environmental atmosphere.

With such fittings, the lamp is contained in an enclosure the pressure in which is maintained at a value different from the ambient pressure. Usually such enclosures would be evacuated, partially or otherwise, and maintained at a state of vacuum according to the requirements of their usage, and so constructed that a vacuum or pressure operated electrical switch or switches operated by a failure or predetermined reduction of vacuum inside the enclosure or enclosures would individually or collectively isolate the apparatus inside the enclosures from an electricity supply or any other risk medium, or alternatively, be arranged to give early alarm with subsequent isolation, so as to allow for remedial action.

According to the present invention, there is provided an electrical lighting fitting comprising a housing defining two enclosures thermally insulated from each other, a lamp, and control equipment for the lamp, the lamp being disposed in one of the enclosures and the control equipment being disposed in the other enclosure the said one enclosures being maintained at a pressure other than the ambient pressure and being provided with means for detecting a change in pressure therein the said means for detecting the change in pressure being operative to discontinue the electrical supply to the fitting in the event of a predetermined pressure change.

Figure 4:
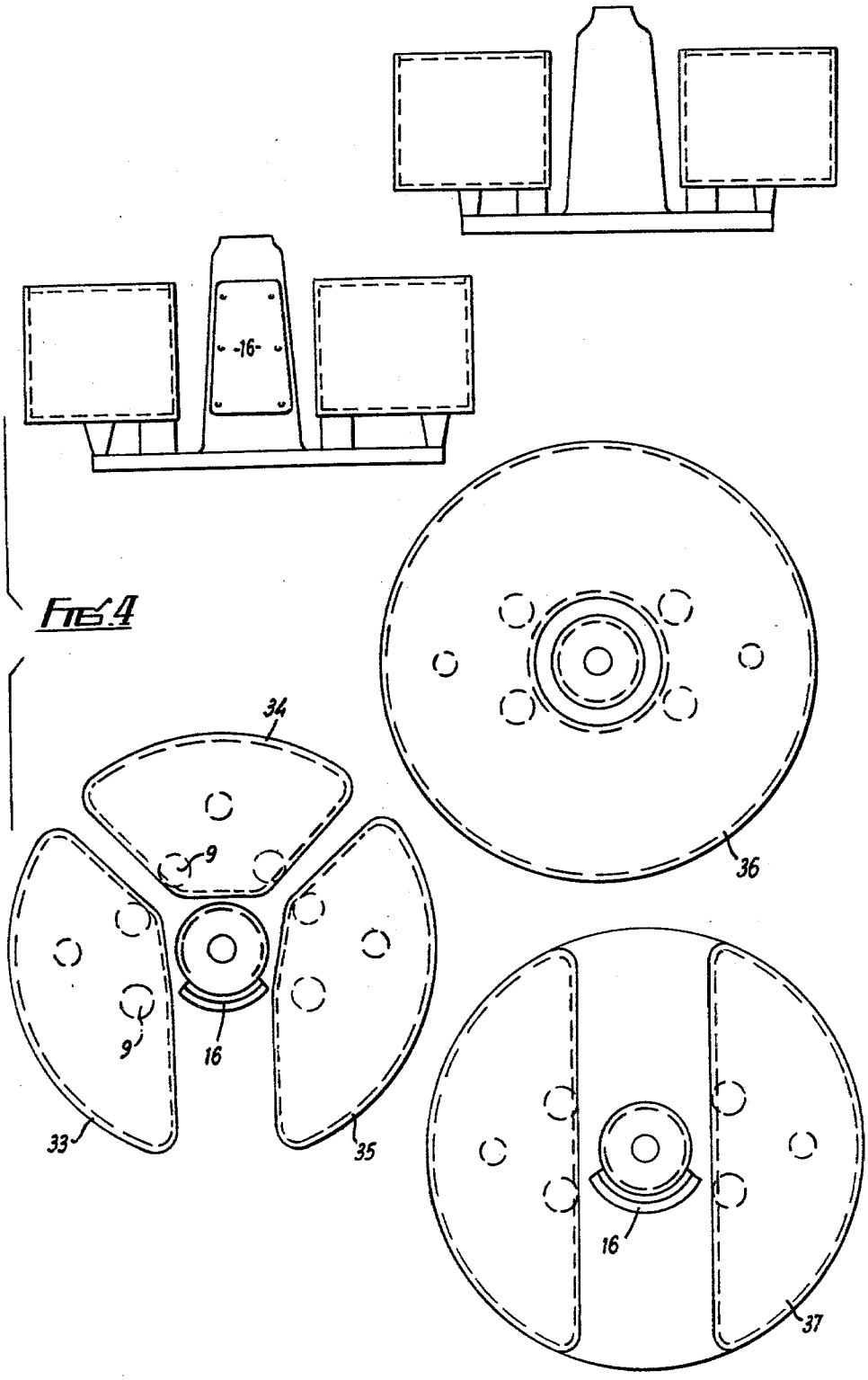
Figure 5:
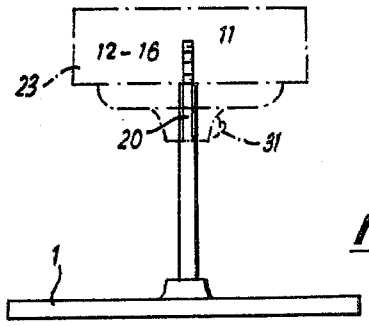
Figure 6:
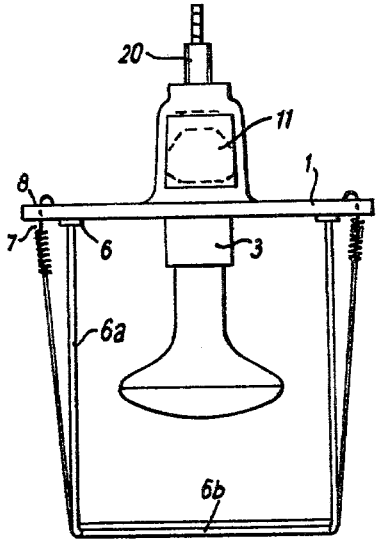
Figure 7:
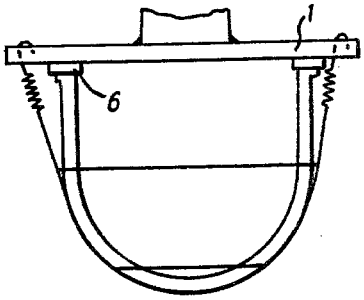

In order that the invention may be more clearly understood, several embodiments of the invention will now be described, by way of example, with reference to the accompanying drawings, in which:

FIG. 1 shows a side sectional elevation of a lighting fitting,

FIG. 1A shows a sectional plan view of the fitting of FIG. 1 taken along the line X—X, FIG. 2 shows side elevational and plan views of an alternative form for an armature of the fitting shown in FIG. 1, FIG. 3 shows a plan view similar to FIG. 1A, but with additional parts of the fitting shown in position, FIG. 4 shows views of an alternative armature to that shown in FIGS. 1, 2 and 3, FIG. 5 shows a modification of the arrangement shown in FIG. 4, FIG. 6 shows a part of an infra-lamp fitting, FIG. 7 shows a fitting which is a well glass fitting, FIG. 8 shows a fitting which is a fluorescent tube fitting, and FIG. 9 shows a fitting incorporating a low pressure sodium lamp with a protective transparent inner enclosure of synthetic plastics material.

FIG. 1 is a diametrical cross section through one form of improved enclosure for a luminaire, showing a central body arrangement of an armature 1 carrying a lamp 2 and its lamp holder 3 mounted in a central cooling chamber 4 which is integral with a lamp enclosure top plate 5.

The top plate 5 is arranged to carry a gasket 6 and lamp glass 6a. Fixing hooks 7 which extend through fixing eye holes 8 are connected to spring strained wires to hold the lamp glass basket in position. Similarly, curtain wire type springs may be used instead of the spring strained wires. All external fixing devices are of stainless steel construction.

The top plate 5 also carries wiring and access holes 9 and fixing holes 7a and 9 to auxiliary component boxes 33 to 37 which are mounted around the central armature.

The central armature cooling chamber 4 (FIG. 1) and 1a (FIG. 2) may be of varying shapes to suit requirements and may serve for mounting any or all of the following equipment, namely, one or more pressure switches 11 main and/or auxiliary fuses, 12, thermal cut-out 13, light cell 14 and isolating switch 15. It may be fitted with an access hole and gasket if required.

The auxiliary component boxes 33 to 37 may be of any convenient shape, size or number as shown on FIGS. 1 4 and 5 for example, and are used for the temperature zoning of auxiliary components to suit their particular limitations of usage.

Sealing and gasketry 32 (FIG. 1) of all enclosures may vary from conventional practice to the use of high temperature adhesives of all types.

In the preferred form shown in FIG. 1, the glass lighting chamber will consist of the glass tube 6a with a bottom plate 6b or bowl held together by adhesive. Alternatively a well glass may be used.

These glasses will be held in position by a metallic non-corrodible basket already mentioned and located in position by adhered protuberances 6c.

Separate pneumatically operated electrical switches for "ON" and "OFF" and other controls may be mounted in the central armature 1 and 1a (FIG. 2) or in the auxiliary component boxes 33 to 37. Suitable provision for capillary tube entry will be made. They may alternatively be of an enclosed type suitable for mounting on the top plate 9a and 10 of the armature.

The armature may be attached to a conduit box 23 of a fixed electrical wiring installation by means of a coaxial threaded plug 20. The base portion of the plug 20 shall carry two screwed stud holes for the mounting of substantial fixing pillars for the lamp holder 17. Alternatively, a threaded two or three wire jack plug, each arranged that they themselves are sealed may be used. In a fixed wiring conduit box, sealing will be effected in situ by means of epoxy putty.

Conventional methods of sealed wiring entry and exit using epoxy putty or equivalent when or where necessary are other alternatives.

The body of the conduit suspension box 23 supporting the fitting, may be of any approved construction, with a suspension hook fitted for easy wiring.

A heat reflecting and light focussing reflector 24 has a heat insulating truncated cone insert 24a fitted around the lampholder 3.

For the purpose of relamping and cleaning the glass, the metal cage holding the glass will have two high tensile stainless stranded wires 29 passed through two elongated holes 27 each having two bobbins 28 adjacent to the holes, such that they locate in a "HOLD" position permitting only a small movement of the basket and glass after the fixing springs 7 have been released. The bobbin 28 can then be rotated to pass through the elongated holes 27 and permit the glass to be lowered to the cleaning position.

The lowering wires may be stored on hooks 30 when not in use or may be loose and fitted with loops to thread through the holes for fixing on the hooks 30 with the connection 31a made of a semi-permanent nature affixed for maintenance purposes. A secret key 31 locking feature can be fitted to the connection 20.

For the application of pressure to charge the enclosure, a Schrader valve with a captive sealing cover nut can be fitted to the armature top plate 9*a*, 10.

An emergency tungsten lamp 25 may be mounted in the fitting (FIG. 1) and controlled by a relay 26 in one of the auxiliary control boxes.

In the above arrangement, in the event of a predetermined pressure rise in the enclosure housing the lamp 2, the pressure switch 11 acts to discontinue the supply to the lamp. Thus in a hazardous environment, where, for example, the atmosphere may contain explosive mixtures of gases, the danger of an explosion due to ingress of gases into the lamp enclosure on damage to that enclosure is reduced. Similarly, where the enclosure is maintained at a pressure above the ambient, the switch 11 may be made to react to discontinue the electrical supply to the lamp in the event of pressure drop on damage to the enclosure.

The lamp of the fitting may be tungsten filament, tungsten ballasted mercury, mercury vapour fluorescent tubes and bulbs, high pressure sodium, low pressure sodium and metal halide lamps.

In general the internal gear of the lamp could be that of any present reputable manufacturer. Indeed it may even be possible to convert existing lamps to bring them into line with the lamp of the invention and thus secure the inventive advantages. Extra items of gear can more readily be added later. Such items might for example be a fuse or photocell which would benefit from a coil location in the fitting, a high pressure sodium ignitor or a heavy current control relay. This ready interchangeability of the various component parts eases blocking which in turn facilitates rapid delivery. Less skill is required in assembly which makes for ease of installation. Lamps types which previously have only when accepted as fulfilling less stringent regulations which of course reduces their sphere of application, may now be able to fulfill more stringent regulation (zone 2).

What is claimed is:

1. An electrical lighting fitting comprising:

(a) a lamp enclosure containing a lamp, (b) an auxiliary enclosure containing control equipment, (c) means for maintaining said lamp enclosure at a pressure other than ambient pressure, (d) means in said lamp enclosure for detecting a change in pressure therein and for discontinuing electrical supply to the fitting in response to a predetermined pressure change, and (e) means for thermally insulating the auxiliary enclosure from the lamp enclosure so as to immunize temperature increase of the control equipment due to heat from the lamp.

2. An electrical lighting fitting as claimed in claim 1, in which the means for detecting a change in pressure comprises a pressure switch.

3. An electrical lighting fitting as claimed in claim 2, in which the pressure switch is set to react to a fall in pressure to discontinue the electrical supply to the lamp.

4. An electrical lighting fitting as claimed in claim 2, in which the pressure switch is set to react to a rise in pressure to discontinue the electrical supply to the lamp.

5. An electrical lighting fitting as claimed in claim 1, in which the two enclosures are thermally insulated from each other by means of a heat reflecting screen.

6. An electrical lighting fitting as claimed in claim 5, including, a lamp holder, and in which the screen coaxially surrounds the lamp holder and also serves as a light focussing reflector.

7. An electrical lighting fitting as claimed in claim 1, in which the lamp is tungsten filament, tungsten ballasted mercury, mercury vapour fluorescent tubes or bulbs, high or low pressure sodium or metal halide.

8. An electrical lighting fitting as claimed in claim 1, in which the said lamp enclosure is partially defined by a well glass.

9. An electrical lighting fitting as claimed in claim 1, in which the said lamp enclosure is partially defined by a glass tube closed at its lower end by a glass plate.

10. An electrical lighting fitting as claimed in claim 9, in which the tube and plate are connected by adhesive.

11. An electrical lighting fitting as claimed in claim 10, in which the adhesive is an epoxy resin.

12. An electrical lighting fitting as claimed in claim 8, in which the glass partially defining the said one enclosure is supported in a basket.

13. An electrical lighting fitting as claimed in claim 12, in which the basket is supported from a plate surrounding and fixed to the body of the fitting by means of detachable springs.

14. An electrical lighting fitting as claimed in claim 13, in which the basket is also connected to the body of the fitting by elongate flexible elements enabling the glass to be gently lowered from the lamp after detachment of the springs to enable lamp maintenance.

15. An electrical lighting fitting as claimed in claim 1, in which the supply to the lamp is through a screw connection.

16. An electrical lighting fitting as claimed in claim 1, in which the supply to the lamp is through a jackplug connection.

* * * * *